US012173906B2

(12) United States Patent
Ha

(10) Patent No.: US 12,173,906 B2
(45) Date of Patent: Dec. 24, 2024

(54) COOKING APPLIANCE

(71) Applicant: LG ELECTRONICS INC., Seoul (KR)

(72) Inventor: Yeonsik Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 404 days.

(21) Appl. No.: 17/678,823

(22) Filed: Feb. 23, 2022

(65) Prior Publication Data

US 2022/0268449 A1 Aug. 25, 2022

(30) Foreign Application Priority Data

Feb. 24, 2021 (KR) ..... 10-2021-0025145

(51) Int. Cl.
*F24C 15/32* (2006.01)
*F24C 15/14* (2006.01)

(52) U.S. Cl.
CPC ..... *F24C 15/32* (2013.01); *F24C 15/14* (2013.01)

(58) Field of Classification Search
CPC F24C 15/2007; F24C 15/2042; F24C 15/001; F24C 15/2014; F24C 15/14; F24C 15/32
USPC ..... 126/21 R; 454/41
See application file for complete search history.

(56) References Cited

U.S. PATENT DOCUMENTS 2,337,349 A 12/1943 Rees
2,387,734 A * 10/1945 Barnsteiner ..... F24C 15/2007 126/21 R
4,598,691 A * 7/1986 Herrelko ..... F24C 3/087 126/41 R
4,633,850 A 1/1987 Hawkins et al.

FOREIGN PATENT DOCUMENTS

KR 20030041273 A 5/2003

* cited by examiner

*Primary Examiner* — Vivek K Shirsat
(74) *Attorney, Agent, or Firm* — Bryan Cave Leighton Paisner LLP

(57) ABSTRACT

Disclosed is a cooking appliance. The present disclosure includes an exhaust passage that is formed inside an exhaust duct and has one side connected to the inside of a cooking chamber through an exhaust port and the other side that is open to an upper portion of a top plate, and a blocking part that is provided inside the exhaust duct having the exhaust passage and blocks at least a portion of a movement path of water flowing downward toward the exhaust port from the exhaust passage.

16 Claims, 12 Drawing Sheets

COOKING APPLIANCE

CROSS-REFERENCE TO RELATED APPLICATION

This application claims priority to and the benefit of Korean Patent Application No. 10-2021-0025145, filed on 2021 Feb. 24, the disclosure of which is incorporated herein by reference in its entirety.

BACKGROUND

1. Field of the Invention

The present disclosure relates a cooking appliance, and more particularly, to a cooking appliance including both of a cooktop part and an oven part.

2. Discussion of Related Art

Cooking appliances are one kind of home appliances for cooking food and are installed in a kitchen space to cook food according to an intention of a user. These cooking appliances may be classified into various types according to a heat source or type being used and the type of fuel.

The cooking appliances are classified according to the type of cooking, the cooking appliances may be classified into open-type cooking appliances and closed type cooking appliances according to the shape of a space in which food is placed. Closed-type cooking appliances include ovens, microwave ovens, and the like, and open-type cooking appliances include cooktops, hops, griddles, and the like.

A closed-type cooking appliance is a cooking appliance provided with a space in which food is located and which is shielded to cook the food by heating the shielded space. The closed-type cooking appliance is provided with a cooking chamber provided with a space which is shielded when food is cooked while the food is placed therein. The cooking chamber provides a space in which the food is substantially cooked.

Closed-type cooking appliances are roughly classified into gas ovens and electric ovens according to the type of a heat source. In a gas oven, a gas is used as a fuel, and as the gas is supplied to a plurality of burners and the burners are ignited, food is cooked by a flame generated while the supplied gas is burned. Unlike the gas oven, in an electric oven, electricity is used as a heat source, and food is cooked by heat emitted from heaters while the plurality of heaters are operated.

A door that selectively opens or closes the cooking chamber may be rotatably provided in the closed-type cooking appliance. The door is rotatably installed in a body, in which the cooking chamber is formed, using a door hinge provided between the body and the door, and as the door is rotated about a portion coupled to the body through the door hinge, the cooking chamber may be selectively opened or closed.

The heat source is provided in an inner space of the cooking chamber opened or closed by the door and heats the cooking chamber. A gas burner, an electric heater, or the like may be used as the heat source.

In addition, the closed-type cooking appliance is provided with an exhaust duct. The exhaust duct is provided to discharge, to the outside of the cooking appliance, combustion gas generated while the food is cooked inside the cooking chamber.

The exhaust duct is provided so that a lower end thereof is connected to an upper portion of the cooking chamber and an upper end thereof is disposed on the rear upper side of the cooking appliance. The combustion gas generated in the cooking chamber flows into the exhaust duct connected to the upper portion part of the cooking chamber, flows upward, and is discharged upward from the rear surface of the cooking appliance through a vent grill provided above the exhaust duct.

At least one exhaust hole through which the combustion gas discharged through the exhaust duct is to pass is provided in the vent grill, and the exhaust hole is formed to vertically pass through the vent grill.

In recent years, complex cooking appliances have been proposed in which the closed-type cooking appliance and the open-type cooking appliance are installed at the same time, a plurality of heat sources are combined, and thus various types of food may be cooked and a plurality of pieces of food may be cooked simultaneously. The cooking appliance in which the plurality of heat sources are installed is accompanied by a flow path of cooling air for cooling the plurality of heat sources and electronic components.

In the complex cooking appliance, the open-type cooking appliance is located on the closed-type cooking appliance. Further, in the open-type cooking appliance, the plurality of heaters or the plurality of burners are installed so that a plurality of dishes may be cooked simultaneously.

That is, when a user cooks an oven dish such as a barbecue dish or bread or a roast dish such as a grilled fish, the cooking is performed using the closed-type cooking appliance, and when the user cooks a general dish in which food is heated while being placed in a container, the cooking is performed using the open-type cooking appliance of which an upper portion is open.

One of the most commonly used open-type cooking appliances is a gas stove-type open cooking appliance, which cooks food using a flame generated when gas is burned by the burner.

The burner provided in this open-type cooking appliance generally includes a burner body, a burner head, and a burner head cap.

Accordingly, the burner body having a flow path through which a gas is supplied is fixedly installed inside a cooktop case forming an outer shape of the open-type cooking appliance, the burner head through which the gas supplied through the flow path is discharged is installed above the burner body, and the burner head cap is installed above the burner head.

A gas supply pipe for supplying a gas and a nozzle for injecting the gas may be mounted on the burner body. Further, the burner head may be located on a member defining an upper surface of the open-type cooking appliance, for example, an upper surface of a top plate, and the burner head cap is seated on the upper side of the burner head.

In the complex cooking appliance, the vent grill is generally disposed on the upper side of a rear surface of the open-type cooking appliance. For example, an upper end of the exhaust duct may pass through the top plate and may be disposed on the rear surface side of the open-type cooking appliance, and the vent grill may be disposed on the upper side thereof, that is, an upper side of the rear surface of the top plate.

Meanwhile, a lower end of the exhaust duct may be connected to an upper surface of a cavity. An exhaust port may be formed to vertically pass through the upper surface of the cavity, and the exhaust duct may be connected to the interior of the cooking chamber through the exhaust port.

The heat source is provided in the inner space of the cooking chamber to heat the cooking chamber, and the gas burner, the electric heater, or the like may be used as the heat source. Among them, as in a broil burner or a broil heater, the heat source disposed above the cooking chamber is disposed adjacent to the exhaust port, and at least a part of the heat source is disposed below the exhaust port.

According to the above structure, water may flow into the exhaust duct through the exhaust hole of the vent grill. Further, the water introduced into the exhaust duct in this way may penetrate toward the heat source disposed below the exhaust duct.

In this way, the water penetrating toward the heat source may affect a normal ignition or operation of the heat source. For example, when the water penetrates into an electric connection part of the broil heater, the risk of an accident increases, and when the water penetrates into an ignitor of the broil burner, the risk of an ignition failure of the broil burner increases.

SUMMARY OF THE INVENTION

The present disclosure is directed to providing a cooking appliance having an improved structure capable of blocking water, which is introduced through an exhaust duct from the outside of the cooking appliance, from penetrating into a heat source.

The present disclosure is also directed to providing a cooking appliance having an improved structure capable of suppressing the occurrence of an ignition failure of a broil burner.

A cooking appliance according to an embodiment of the present disclosure includes an exhaust passage that is formed inside an exhaust duct and has one side connected to the inside of a cooking chamber through an exhaust port and the other side that is open to an upper portion of a top plate, and a blocking part that is provided inside the exhaust duct having the exhaust passage and blocks at least a portion of a movement path of water flowing downward toward the exhaust port from the exhaust passage.

In this way, a water flow path through which water flows from the exhaust passage through the exhaust port to an ignition device is blocked using the provided blocking part, and thus penetration of the water introduced through the exhaust duct from the outside of the cooking appliance may be effectively blocked.

Further, according to another aspect of the present disclosure, a blocking part is disposed between an upper end of an exhaust passage and an ignition device, and the blocking part blocks a movement path of water flowing downward from the exhaust passage to the ignition device.

Thus, a water flow path through which water flows from the exhaust passage through an exhaust port to the ignition device may be blocked by the blocking part, and as a result, occurrence of an ignition failure of a broil burner may be effectively suppressed.

A cooking appliance according to an aspect of the present disclosure includes an oven part including a cavity in which a cooking chamber is formed, a cooktop part that includes a top plate covering an upper portion of the cavity so that an upper space is formed between the cavity and the top plate and at least one cooktop heating part of which at least a portion is disposed in the upper space, and an exhaust duct that forms a passage connecting an inside of the cooking chamber and an upper portion of the top plate, wherein the oven part includes an exhaust port vertically passing through one side surface of the cavity that faces the cooktop part, an exhaust passage having one side connected to the exhaust port and the other side that is open to the upper portion of the top plate is formed inside the exhaust duct, and the blocking part that blocks at least a portion of a movement path of water flowing downward toward the exhaust port from the exhaust passage is provided inside the exhaust duct.

The blocking part may be disposed between the other side of the exhaust passage and the exhaust port and may be provided to protrude vertically from the one side surface of the cavity.

The blocking part may be provided on the one side surface of the cavity and may protrude vertically.

The blocking part may be formed integrally with the cavity.

A portion of the one side surface of the cavity may be vertically perforated to form the exhaust port, and the blocking part may be formed in a form in which a portion of an edge of the cavity surrounding the exhaust port extends upward.

The cooking appliance may further include a burner disposed inside the cooking chamber.

The burner may include an ignition device disposed below the exhaust port.

The blocking part may be disposed between the other side of the exhaust passage and the ignition device to block a movement path of water flowing downward toward the ignition device from the exhaust passage.

The blocking part may be disposed behind the ignition device, a width of the blocking part in a left-right direction may be greater than a width of the ignition device in the left-right direction, and the blocking part may protrude further than the ignition device in the left-right direction.

The exhaust duct may include a first duct part having a first exhaust passage formed therein and connected to the exhaust port and a second duct part having a second exhaust passage formed therein and having one side connected to the first exhaust passage and the other side that is open to the upper portion of the exhaust port.

The second duct part may be disposed behind the exhaust port, the first duct part may extend to be inclined upward from the exhaust port toward the second duct part, and the blocking part may be disposed inside the first duct part.

The first duct part may include a plurality of sidewalls connecting the one side surface of the cavity and the second duct part, the plurality of sidewalls may be connected to each other while surrounding the first exhaust passage in a front-rear direction and in the left-right direction, and the blocking part may be disposed between the exhaust port and a rear sidewall that is a rearmost sidewall among the plurality of sidewalls.

The rear sidewall and the exhaust port may be connected to each other by the one side surface of the cavity, and the blocking part may protrude upward from the one side surface of the cavity.

The first duct part may further include a coupling part protruding from the plurality of sidewalls and coupled to the one side surface of the cavity, and the coupling part may protrude from a lower end of at least one of the plurality of sidewalls in a direction parallel to the one side surface of the cavity.

The coupling part may include a first protrusion part extending rearward from the rear sidewall and protruding rearward from the rear sidewall and a second protrusion part extending from a lower end of the first protrusion part and protruding forward from the rear sidewall.

The blocking part may extend upward from a front end of the second protrusion part and protrude upward from an upper portion of the one side surface of the cavity.

The portion of the one side surface of the cavity may be vertically perforated to form the exhaust port, and a protrusion wall part protruding upward from the edge of the cavity surrounding the exhaust port may be provided in the vicinity of the exhaust port.

The blocking part may be formed in a form in which the portion of the edge of the cavity surrounding the exhaust port extends upward, and a height of the blocking part may be greater than a height of the protrusion wall part.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
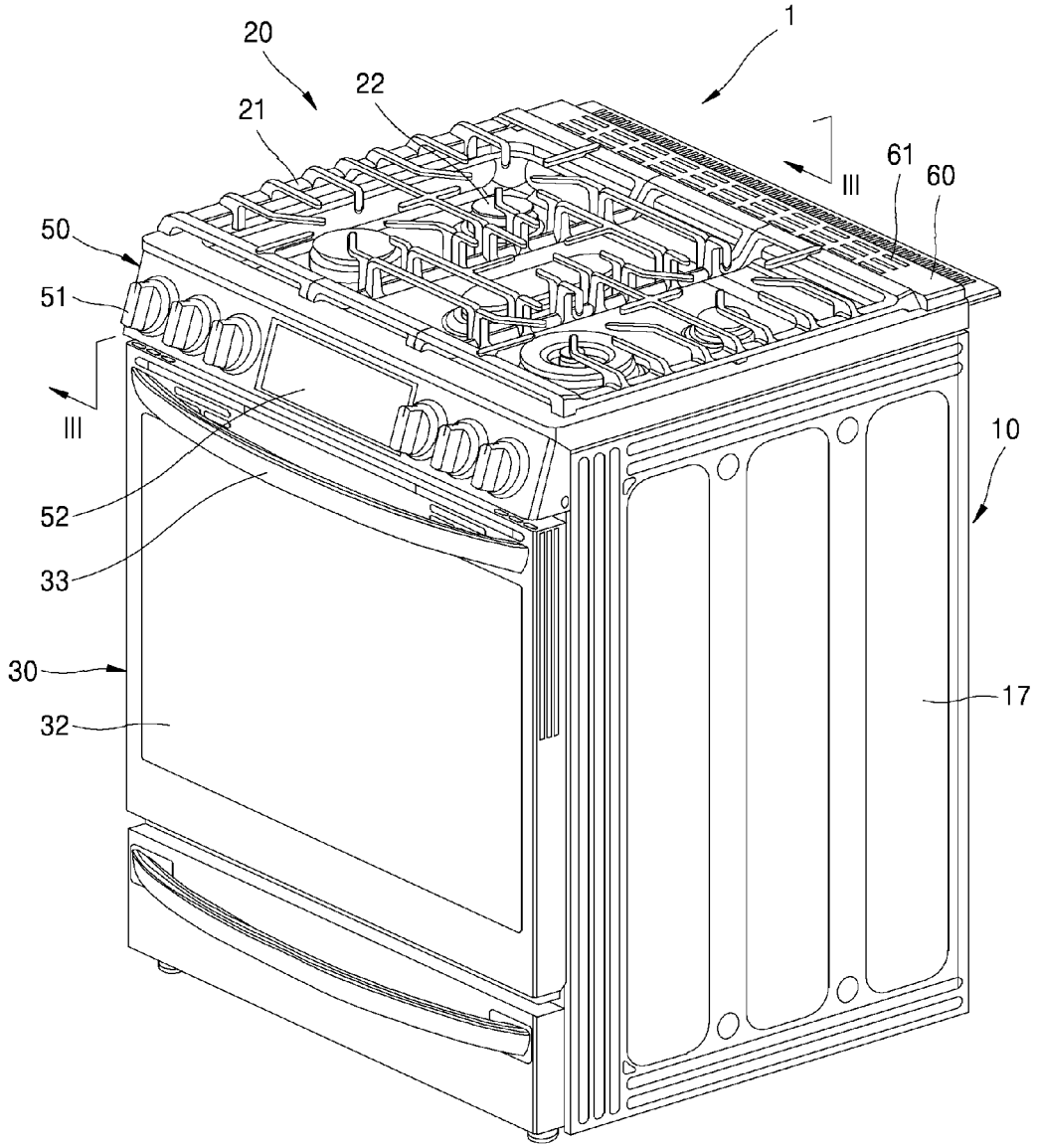
FIG. 1 is a perspective view illustrating a cooking appliance according to an embodiment of the present disclosure.

The above-described purposes, features, and advantages will be described in detail with reference to the accompanying drawings, and accordingly, those skilled in the art to which the present disclosure pertains may easily implement the technical spirit of the present disclosure. In the description of the present disclosure, when it is determined that a detailed description of widely known technologies related to the present disclosure may make the subject matter of the present disclosure unclear, the detailed description may be omitted. Hereinafter, embodiments of the present disclosure will be described in detail with reference to the accompanying drawings. In the drawings, the same reference numerals are used to indicate the same or similar components.

Although first, second, and the like are used to describe various components, it is apparent that these components are not limited by these terms. These terms are only used to distinguish one component from another component, and it is apparent that a first component may be a second component unless particularly otherwise stated.

The present disclosure is not limited to the following embodiments, but various changes may be made, and the present disclosure may be implemented in various different forms. The present embodiment is merely provided to complete the disclosure of the present disclosure and to fully inform those skilled in the art of the scope of the present disclosure. Thus, it should be understood that the present disclosure is not limited to the following embodiments and includes all changes, equivalents, or substitutes included in the technical spirit and scope of the present disclosure as well as substituting or adding a configuration of any one embodiment for or to a configuration of another embodiment.

It should be understood that the accompanying drawings are merely provided to easily understand the embodiments disclosed in the present specification, the technical spirit disclosed in the present specification is not limited by the accompanying drawings, and the accompanying drawings include all changes, equivalents, and substitutes included in the spirit and technical scope of the present disclosure. In the drawings, the sizes or thicknesses of components may be expressed exaggeratedly large or small in consideration of convenience of understanding or the like, but the protection scope of the present disclosure should not be interpreted as being limited thereto.

Terms used in the present specification are used only to describe specific implementations and embodiments and are not intended to limit the present disclosure. Further, singular expressions include plural expressions unless clearly otherwise indicated in the context. In the specification, terms such as includes or consists of are intended to designate the presence of a feature, a number, a step, an operation, a component, a part, or combinations thereof described in the specification. That is, in the specification, it should be understood that the terms such as includes and consists of do not preclude the possibility of existence or addition of one or more features, numbers, steps, operations, components, parts, or combinations thereof.

Terms including an ordinal number such as first and second may be used to describe various components, but the components are not limited by the terms. The terms are used only for the purpose of distinguishing one component from another component.

It should be understood that, when it is referenced that a first component is "connected" or "coupled" to a second component, the first component may be directly connected or coupled to the second component or a third component may be present between the first component and the second component. On the other hand, it should be understood that, when a first component is "directly connected" or "directly coupled" to a second component, a third component is not present therebetween.

It should be understood that when it is referenced that a first component is located "above" or "below" a second component, a third component may be present therebetween as well as the first component may be present directly above the second component.

Unless otherwise defined, all terms used herein including technical or scientific terms have the same meanings as those commonly understood by those skilled in the art to which the present disclosure belongs. Terms defined in commonly used dictionaries should be interpreted as having the same meanings in the context of the related art and may not be interpreted with ideal or excessively formal meanings, unless explicitly defined in the present application.

A direction in which a door is installed with respect to the center of a cooking appliance in a state in which the cooking appliance is placed on the floor is defined as a forward direction. Thus, a direction in which food enters the cooking appliance while the door is opened is defined as a rearward direction. For convenience, a direction toward the front side or the rear side may be referred to as a first direction. Then, the front side may be one side of the first direction, and the rear side may be the other side of the first direction.

Further, a direction of gravity may be defined as a downward direction, and a direction opposite to the direction of gravity may be defined as an upward direction.

Further, a horizontal direction perpendicular to the front-rear direction of the cooking appliance, that is, a width direction of the cooking appliance when the cooking appliance is viewed from the front side of the door of the cooking appliance may be referred as to a left-right direction. For convenience, the left-right direction may be defined as a second direction. Then, the right side may be one side of the second direction, and the left side may be the other side of the second direction.

Further, the width direction of the cooking appliance may be defined as a lateral direction. Then, the right side may be one side of the lateral direction, and the left side may be the other side of the lateral direction.

Further, the above-described up-down direction may be defined as a third direction. Then, the upper side may be one side of the third direction, and the lower side may be the other side of the third direction.

Further, the above-described up-down direction may be defined as a vertical direction. Then, the front-rear direction and the left-right direction, that is, the first direction and the second direction, may be referred to as a horizontal direction.

Throughout the specification, when "A and/or B" is used, this means A, B or A and B unless otherwise stated, and when "C to D" is used, this means that a value is greater than or equal to C and less than or equal to D unless otherwise stated.

[Overall Structure of Cooking Appliance]

Figure 2:
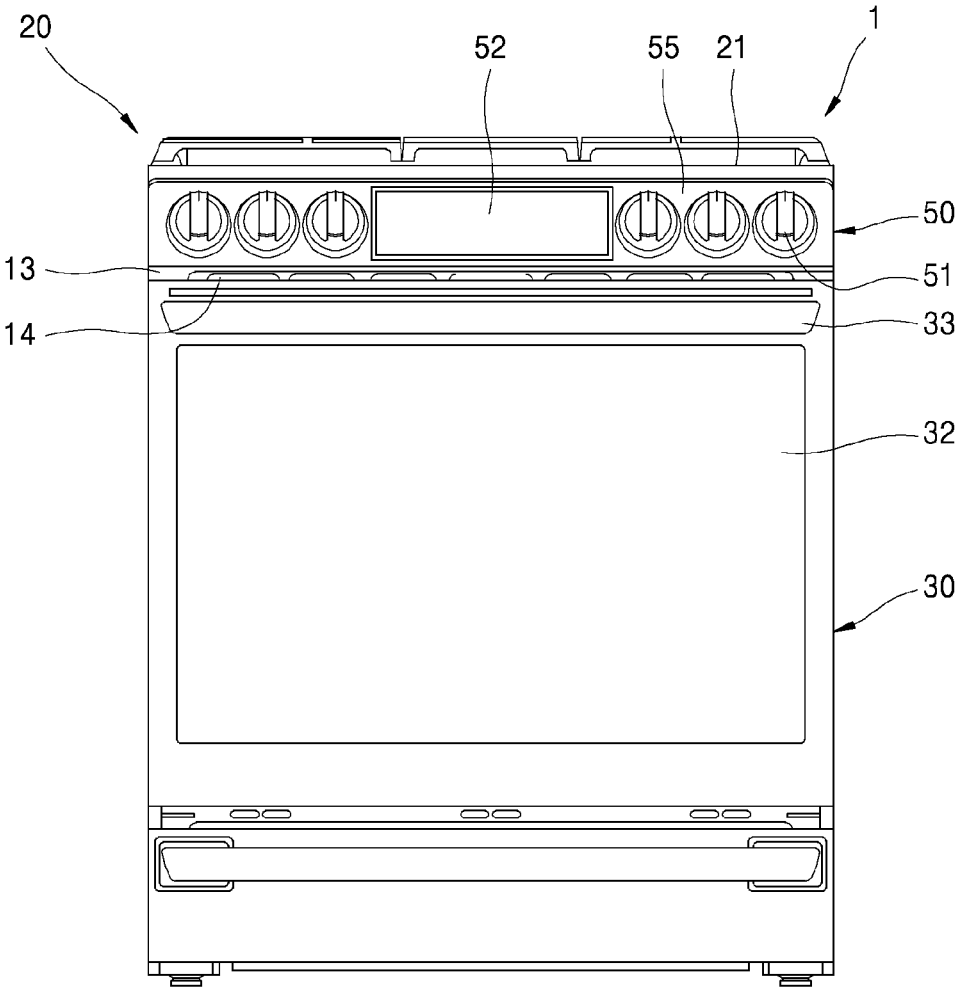
FIG. 2 is a front view of the cooking appliance illustrated in FIG. 1.
Figure 3:
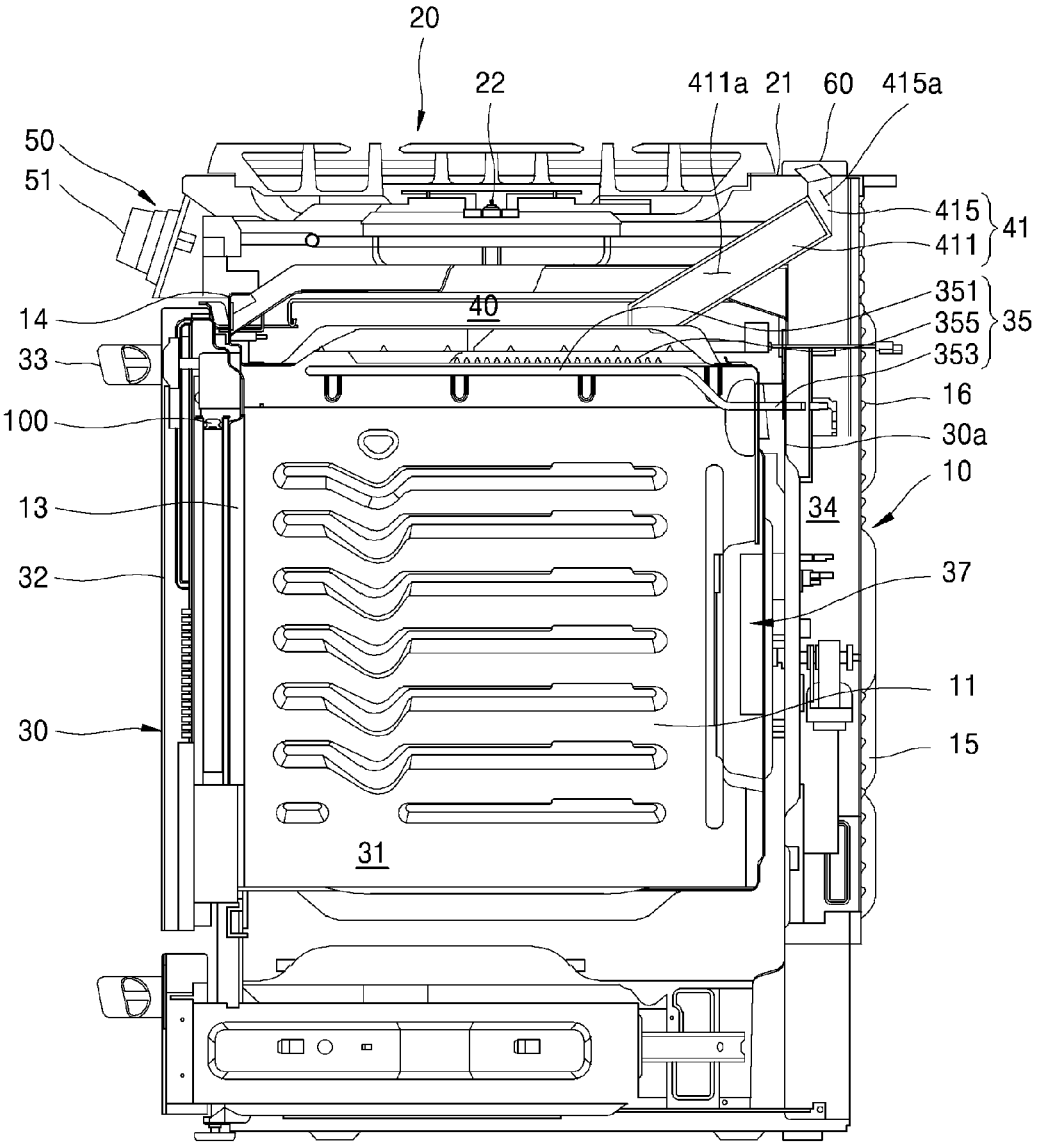
FIG. 3 is a side cross-sectional view illustrating an internal configuration of the cooking appliance illustrated in FIG. 1.

FIG. 1 is a perspective view illustrating a cooking appliance according to an embodiment of the present disclosure, FIG. 2 is a front view of the cooking appliance illustrated in FIG. 1, and FIG. 3 is a side cross-sectional view illustrating an internal configuration of the cooking appliance illustrated in FIG. 1.

Referring to FIGS. 1 to 4, the cooking appliance according to the embodiment of the present disclosure may include a cooktop part 20 and an oven part 30.

An outer shape of a cooking appliance 1 may be formed by a body 10. The body 10 may be provided in a form including a substantially rectangular parallelepiped shape and may be formed of a material having a predetermined strength to protect a plurality of parts installed in an inner space thereof.

The body 10 may include a cavity 11 forming a frame of the body 10 and a front panel 13 disposed in the front of the cavity 11 and forming a front surface of the body 10. A cooking chamber 31 may be formed inside the cavity 11, and an opening which makes the front of the cooking chamber 31 open may be formed inside the front panel 13.

The cooktop part 20 may be disposed above the body 10. The cooktop part 20 may be provided to cook food by heating an open space, that is, food placed on the upper side thereof or a container in which food is contained. The cooktop part 20 may be provided with a top plate 21 that closes an upper end of the body 10 while forming an exterior of an upper surface of the cooktop part 20.

At least one cooktop heating part 22 for heating to-be-cooked food or the container in which food is contained may be disposed in the cooktop part 20.

As an example, the cooktop heating part 22 may be provided as a heating device using a gas fuel. As another example, the cooktop heating part 22 may be provided as a heater or induction heating part using electricity. In this way, a structure of the cooktop heating part 22 may be changed according to the type of a heat source being used.

Further, the oven part 30 may be disposed below the cooktop part 20. The cooking chamber 31 providing a space in which food is cooked may be provided in an inner space of the oven part 30.

The cavity 11 may be formed in the form of a hexahedron having an open front surface, and the cooking chamber 31 may be formed inside the cavity 11. That is, the cooking chamber 31 may be formed with a space disposed inside the cavity 11 and having a substantially hexahedral shape and may be formed as a front open space.

In a state in which the cooking chamber 31 is shielded, while the inside of the cooking chamber 31 is heated, food may be cooked. That is, in the oven part 30, the cooking chamber 31 a space in which food is substantially cooked.

The cooking appliance may be provided with a heating part that heats the cooking chamber 31. The heating part may be provided as a heating device using a gas fuel. As another example, the heating part may be also provided as a heater using electricity. In this way, a structure of the heating part may be changed according to the type of a heat source being used.

In the present embodiment, it is exemplified that the heating part is provided as a heating device using a gas fuel. Accordingly, a broil burner 35 that heats an inner space of the cooking chamber 31 from the upper side may be provided above the cooking chamber 31, and a baker burner-type burner that heats the inner space of the cooking chamber 31 from the lower side may be further provided below the cooking chamber 31.

Further, a convection part 37 that heats the inner space of the cooking chamber 31 by convection of hot air may be further provided behind the cooking chamber 31.

The convection part 37 allows air in the inner space of the cooking chamber 31 to forcibly flow. That is, the convection part 37 suctions and heats the air in the inner space of the cooking chamber 31, then allows the air to flow while the air is discharged to the inner space of the cooking chamber 31, and thus heats the inner space of the cooking chamber 31, thereby uniformly heating food located in the inner space of the cooking chamber 31.

A door 32 that selectively opens or closes the cooking chamber 31 may be rotatably provided in the oven part 30. As an example, the door 32 may be provided to open or close the cooking chamber 31 in a pull-down manner in which an upper end thereof vertically rotates about a lower end thereof.

The door 32 may be formed in an overall hexahedral shape having a predetermined thickness. A handle 33 may be disposed in the front of the door 32. The handle 33 is provided to be gripped when a user wants to rotate the door 32. The user may easily rotate the door 32 using the handle 33.

A control panel 50 may be provided on an upper front portion of the cooking appliance, that is, an upper front surface of the cavity 11. The control panel 50 may form a part of a front outer shape of the cooking appliance. The control panel 50 may be provided with a knob 51 for adjusting an operation of the cooking appliance, a display 52 that displays an operation state of the cooking appliance, and the like.

For example, the control panel 50 may be provided in a form in which an input unit 51 and the display 52 are installed in a control panel cover 50*a* disposed above the door 32 and in the front of the cooktop part 20.

The input unit 52 may be provided with a plurality of operation switches through which the user may directly input an operation signal. In this case, the operation switch may be provided in the form of a knob capable of a rotation operation or may be provided in the form of a button or panel capable of a pushing operation or a touch operation.

Further, the control panel 50 may be further provided with the display 52 that provides operation information on the cooking appliance, cooking information on food, or the like. The user may identify various pieces of information on the cooking appliance through the display 52.

As another example, the display 52 may be provided in the form of a touch panel capable of a touch operation, and accordingly, the input unit 51 and the display 52 may both be configured on one touch panel.

Meanwhile, a rear space 34 may be provided behind the cooking chamber 31. The rear space 34 is disposed behind the cavity 11 and is a space partitioned from the cooking chamber 31 by a partition surface 30*a* that partitions the cooking chamber 31 and the rear space 34 in the front-rear direction. A front boundary surface of the rear space 34 may be defined by the partition surface 30*a*, and a rear boundary surface of the rear space 34 may be defined by a rear cover 15 installed behind the cavity 11.

An upper space 40 may be provided outside the cavity 11. The upper space 40 may be disposed above the cavity 11 and behind the control panel 50. A space in which parts or electrical components constituting the cooktop heating part 22 are to be installed may be formed inside the upper space 40.

A front surface of the upper space 40 may be shielded by the front panel 13. The front panel 13 may be disposed between the cavity 11 and the door 32. At least a portion of the front panel 13 may be disposed to block the front side of the upper space 40. For example, an upper region of the front panel 13 disposed above the cooking chamber 31 may shield the front surface of the upper space 40.

The front panel 13 may be provided with an intake port 14. The intake port 14 may be formed to pass through the front panel 13 in the front-rear direction. The intake port 14 may form, on the front panel 13, a passage through which air outside the upper space 40 is to flow into the upper space 40.

[Structure of Cooktop Part]

As described above, the cooktop part 20 is disposed above the oven part 30 and may include the top plate 21 and the cooktop heating part 22.

The top plate 21 may be disposed above the cavity 11, and the upper space 40 may be disposed between the top plate 21 and the cavity 11. That is, the top plate 21 may cover an upper portion of the cavity 11 so that the upper space 40 is formed between the top plate 21 and the cavity 11.

The upper space 40 may be provided outside the cavity 11. The upper space 40 may be disposed between the cavity 11 and the top plate 21 and behind the control panel 50. The space in which parts or electrical components constituting the cooktop heating part 22 are to be installed may be formed inside the upper space 40.

For example, when the cooktop heating part 22 is provided as a heating device using a gas fuel, a burner for burning gas, a supply pipe for supplying the gas to the burner, a valve for adjusting supply of the gas to the burner, and the like may be arranged in the upper space 40.

As another example, when the cooktop heating part 22 is provided as a heating device using electricity, the heater, the induction heating part, and various electrical components for driving the heater and the induction heating part may be arranged in the upper space 40.

The body 10 may further include side panels 17. The side panels 17 may be arranged on both sides of the cavity 11. The side panels 17 may cover lateral sides of the cavity 11 from the outside of the cavity 11 and form a lateral exterior of the body 10.

The side panels 17 may cover the lateral sides of the cavity 11 and may be formed to extend upward from the cavity 11. Accordingly, a lateral boundary surface of the upper space 40 may be defined by the pair of side panels 17 extending upward from both sides of the cavity 11.

The rear cover 15 may be disposed behind the cavity 11. The rear cover 15 may cover the rear side of the cavity 11 and form a rear exterior of the body 10. The rear cover 15 may define a rear boundary surface of the rear space 34 provided behind the cavity 11.

Further, the rear cover 15 may be provided with a vent hole 16. The vent hole 16 may be formed to pass through the rear cover 15 in the front-rear direction, and an air inflow/outflow passage for cooling electrical components arranged inside the rear space 34 may be formed on the rear cover 15.

The rear cover 15 may cover the rear side of the cavity 11 and form to extend upward from the cavity 11. Accordingly, a rear boundary surface of the upper space 40 may be defined by the rear cover 15 extending upward from the rear side of the cavity 11.

That is, the front side, the rear side, and both lateral sides of the upper space 40 are surrounded by the front panel 13, the rear cover 15, and the pair of side panels 17, and the top plate 21 covers an upper portion of the upper space 40.

The top plate 21 may be disposed above the front panel 13, the rear cover 15, and the pair of side panels 17 and may be coupled to each of the front panel 13, the rear cover 15, and the pair of side panels 17. That is, the top plate 21 may be fixed to the upper portion of the upper space 40 while being coupled to each of the front panel 13, the rear cover 15, and the pair of side panels 17.

An exhaust duct 41 may be provided to discharge, to the outside of the cooking appliance, combustion gas generated while food is cooked inside the cooking chamber 31.

The exhaust duct 41 may be provided so that a lower end thereof is connected to an upper portion of the cooking chamber 31 and an upper end thereof is disposed on an upper rear side of the cooking appliance 1. For example, the upper end of the exhaust duct 41 may be disposed behind the cooktop part 20. In the present embodiment, it is exemplified that the upper end of the exhaust duct 41 passes through the top plate 21 and is open to an upper portion of the cooktop part 20.

Accordingly, the combustion gas generated in the cooking chamber 31 may flow into the exhaust duct 41 connected to the upper portion of the cooking chamber 31, may flow upward, and may be discharged upward from the rear surface of the cooking appliance 1 through the upper end of the exhaust duct 41.

A vent grill 60 may be disposed above the exhaust duct 41. The vent grill 60 is provided to cover the upper end of the exhaust duct 41 from an upper portion of the top plate 21.

The vent grill 60 may be provided to cover, from the top, a rear partial area of the top plate 21 including an area in which the upper end of the exhaust duct 41 is disposed. The vent grill 60 may cover, from the top, a portion in which the rear space 34 that is a space between a rear surface of the cavity 11 and the rear cover 15 is open upward, that is, an upper end opening formed between the partition surface 30*a* and the rear cover 15. Accordingly, a space surrounded by the vent grill 60, the top plate 21, and the rear cover 15 may be formed inside the vent grill 60.

In the present embodiment, it is exemplified that the vent grill 60 has a hexahedral shape having an open lower portion. At least one vent hole 61 through which the combustion gas discharged through the exhaust duct 41 is to pass may be provided in the vent grill 60. The vent hole 61 may be formed to vertically pass through an upper surface of the vent grill 60.

[Broil Burner and Surrounding Structure Thereof]

Figure 4:
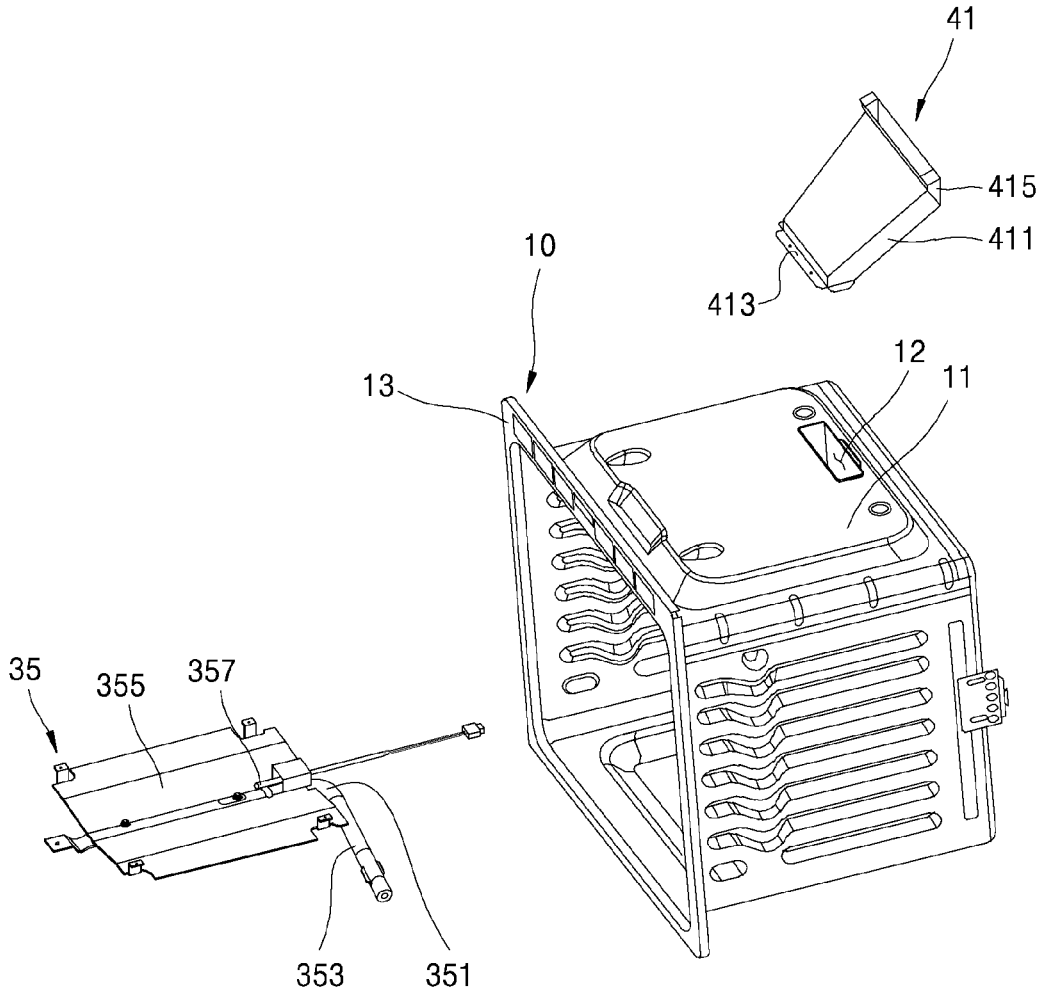
FIG. 4 is an exploded perspective view illustrating a state in which a cavity, a broil burner, and an exhaust duct illustrated in FIG. 3 are separated.
Figure 5:
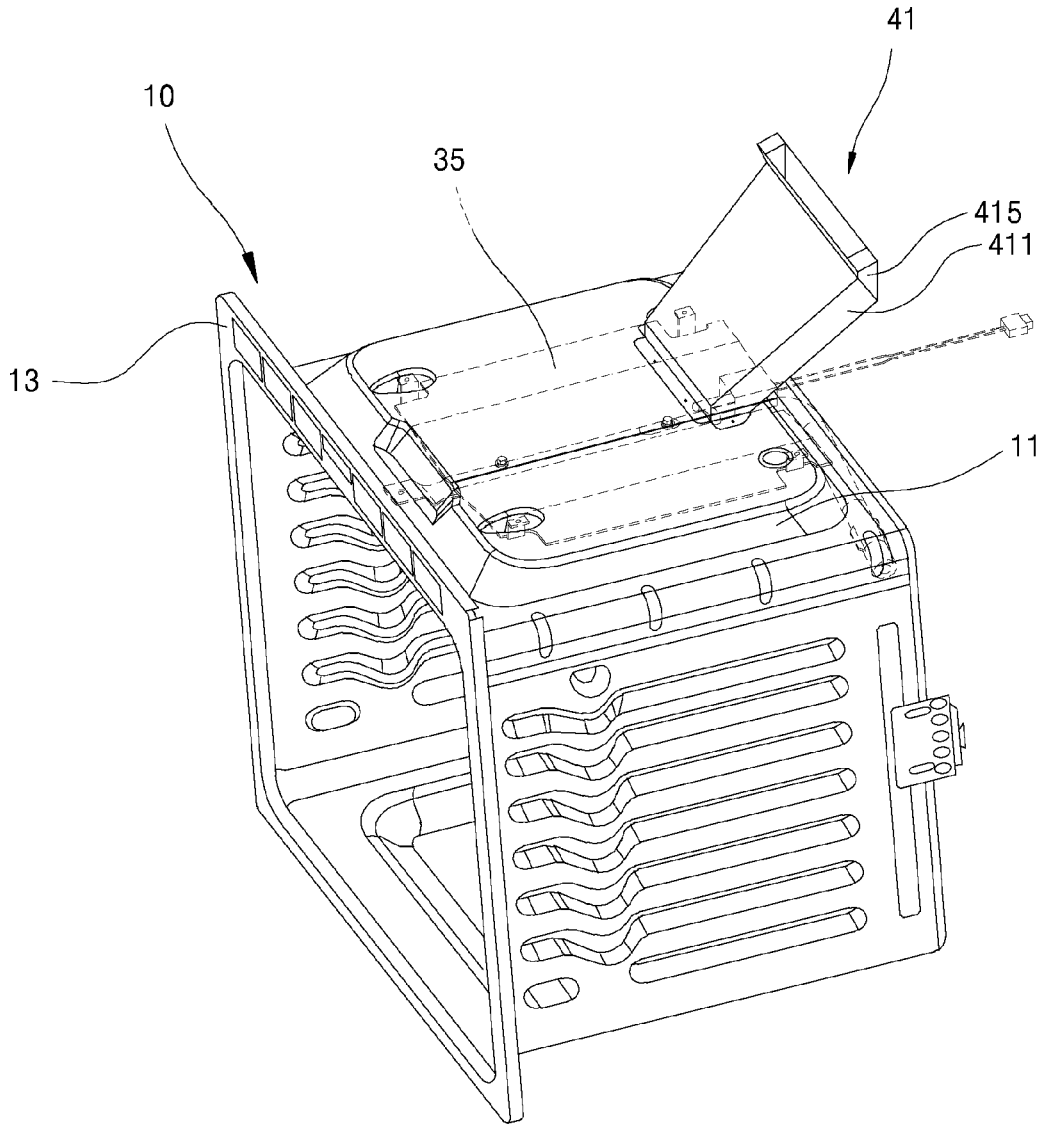
FIG. 5 is a perspective view illustrating a coupling state of the cavity, the broil burner, and the exhaust duct illustrated in FIG. 4.
Figure 6:
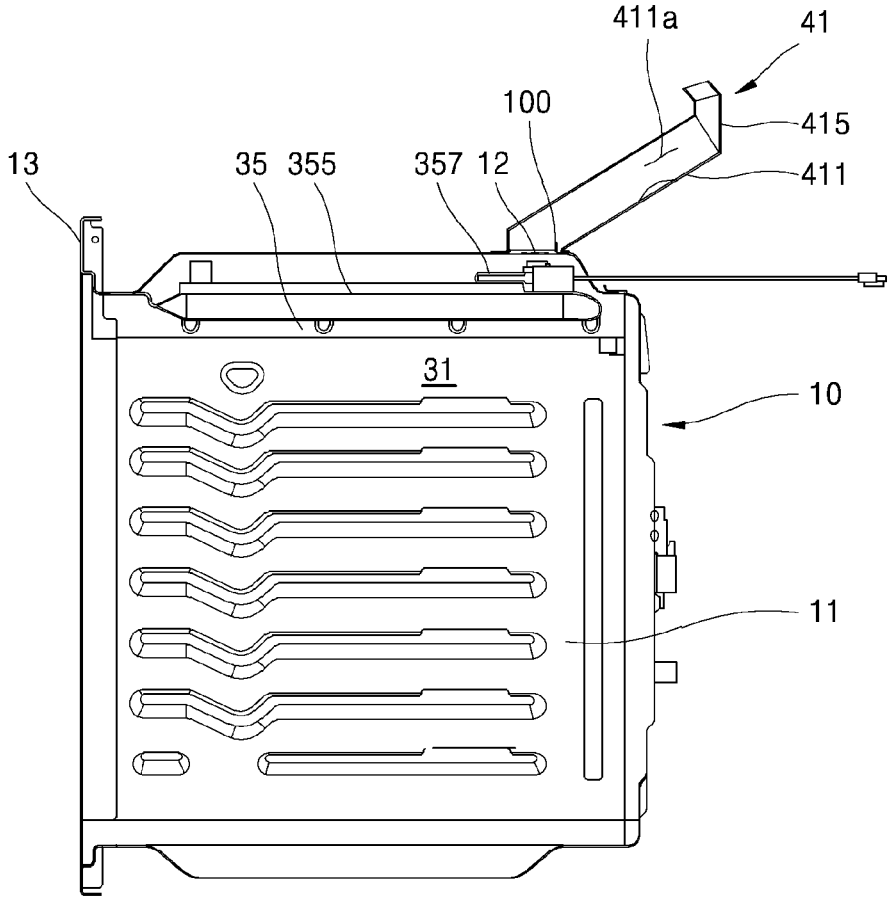
FIG. 6 is a side cross-sectional view illustrating a coupling state of the cavity, the broil burner, and the exhaust duct illustrated in FIG. 5.

FIG. 4 is an exploded perspective view illustrating a state in which a cavity, a broil burner, and an exhaust duct illustrated in FIG. 3 are separated, FIG. 5 is a perspective view illustrating a coupling state of the cavity, the broil burner, and the exhaust duct illustrated in FIG. 4, and FIG. 6 is a side cross-sectional view illustrating a coupling state of the cavity, the broil burner, and the exhaust duct illustrated in FIG. 5.

Referring to FIGS. 3 to 6, a broil burner 35 may be provided inside the cooking chamber 31. The broil burner 35 may heat the inside of the cooking chamber 31 from the upper portion of the cooking chamber 31.

In the present embodiment, the broil burner 35 includes a burner body 351, a mixing tube 353, and an ignition device 357.

The burner body 351 is provided above the cooking chamber 31. The burner body 351 may be coupled to an upper surface of the cooking chamber 31 and may be formed in the form of a linear pipe having a length extending in the front-rear direction (hereinafter, referred to as a "front-rear direction") of the body 10.

A passage to which mixed gas is supplied may be formed inside the burner body 351 to extend in the front-rear direction. Further, a flame hole may be formed to pass through a side portion of the burner body 351, and the flame hole forms a passage through which a gas inside the burner body 351 is discharged to the outside of the burner body 351.

A plurality of flame holes may be arranged on the side portion of the burner body 351 to be spaced apart from each other at predetermined intervals in a length direction of the burner body 351. Accordingly, a plurality of gas discharge passages may be provided in the burner body 351 in the length direction of the burner body 351.

According to the present embodiment, the burner body 351 may receive a gas mixed with air, that is, a mixed gas, through a mixing tube 353, which will be described below, and in this way, the mixed gas supplied to the passage inside the burner body 351 may be combusted, while being discharged to the outside of the burner body 351 through the flame hole, so as to generate a flame outside the burner body 351.

The mixing tube 353 may be formed in the form of a linear pipe having one side connected to the burner body 351. In the present embodiment, it is exemplified that the burner body 351 is formed in the form of a linear pipe extending in the front-rear direction, the mixing tube 353 is formed in the form of a linear pipe extending in a left-right direction (hereinafter, referred to as a "left-right direction) of the body 10, and the burner body 351 and the mixing tube 353 are connected to form an "]" shape.

A mixing passage in which a gas and air are mixed is formed inside the mixing tube 353. The mixing passage provides a space which is formed inside the mixing tube 353 formed in the form of a hollow pipe and in which a gas and air introduced into the mixing tube 353 may be mixed while flowing in a direction from the inside of the mixing tube 353 toward the burner body 351.

In addition, a reflector 355 may be installed in the broil burner 35. The reflector 355 may serve to reflect the flame and heat generated while the mixed gas is burned in the broil burner 35 in the downward direction, that is, toward food inside the cooking chamber 31.

Further, the reflector 355 may serve to cause the combustion gas generated while the mixed gas is burned in the broil burner 35 to flow in the upward direction of the reflector 355, that is, to a space between a ceiling surface of the cooking chamber 31 and an upper surface of the reflector 355.

An exhaust port 12 may be formed to vertically pass through an upper surface of the cavity 11. The exhaust duct 41 may be connected to the inside of the cooking chamber 31 through this exhaust port 12. The exhaust duct 41 may be provided to discharge, to the outside of the cooking appliance 1, the combustion gas generated while food is cooked inside the cooking chamber 31.

The exhaust duct 41 may be provided so that the lower end thereof is connected to an upper portion of the cooking chamber 31 and the upper end thereof is disposed on an upper rear side of the cooking appliance 1. For example, the upper end of the exhaust duct 41 may be disposed behind the cooktop part 20.

In the present embodiment, it is exemplified that the exhaust duct 41 includes a first duct part 411 and a second duct part 415. The first duct part 411 and the second duct part 415 may be arranged to be vertically connected, the first duct part 411 may be disposed on the lower side thereof, and the second duct part 415 may be disposed on the upper side thereof.

The first duct part 411 is disposed adjacent to the exhaust port 12. The first duct part 411 may be disposed on one side surface of the cavity 11, that is, the upper surface of the cavity 11, and the second duct part 415. A first exhaust passage 411*a* connected to the exhaust port 12 may be formed inside the first duct part 411.

The first duct part 411 may include a plurality of sidewalls connecting the upper surface of the cavity 11 and the second duct part 415. In the first duct part 411, the plurality of sidewalls may be connected to each other while surrounding the first exhaust passage 411*a* in the front-rear direction and the left-right direction. For example, the first duct part 411 may be formed in a form in which four side walls are connected to form a quadrangular shape, in other words, in the form of a hexahedral shape including four sidewalls and having an open upper end and an open lower end.

In addition, the first duct part 411 may further include a coupling part 413. The coupling part 413 is provided to couple the exhaust duct 41 and the cavity 11. The coupling part 413 may protrude from a plurality of sidewalls to be coupled to one side surface of the cavity 11, that is, the upper surface of the cavity 11.

The coupling part 413 may protrude from a lower end of any one of the plurality of sidewalls in a direction parallel to one side surface of the cavity 11. For example, the coupling part 413 may protrude from the lower end of each of the sidewalls, and the coupling part 413 may protrude from the lower end of the sidewall and, along with the sidewall, may form an "L" shape.

The second duct part 415 may be disposed between the first duct part 411 and the vent grill 60. A second exhaust passage 415*a* may be formed inside the second duct part 415. One side of the second exhaust passage 415*a* may be connected to the first exhaust passage 411*a*, and the other side of the second exhaust passage 415*a* may be open to the upper side of the exhaust port 12.

In detail, a lower end of the second exhaust passage 415*a* may be connected to the first exhaust passage 411*a*, and an upper end of the second exhaust passage 415*a* may be open to the vent grill 60. The first exhaust passage 411*a* and the second exhaust passage 415*a* are connected vertically, and the first exhaust passage 411*a* and the second exhaust passage 415*a* connected in this way may be collectively called exhaust passages 411*a* and 415*a*.

The second duct part 415 may be disposed behind the exhaust port 12. That is, the second duct part 415 may be disposed behind a lower end of the first duct part 411. The first duct part 411 connecting the second duct part 415 and the exhaust port 12 may extend from the exhaust port 12 toward the second duct part 415 in an upwardly inclined direction. That is, the first duct part 411 may be installed to be inclined in the rearward direction as the first duct part 411 goes to the upper side.

Accordingly, a rear sidewall 412 that is a sidewall located at the rearmost location among the plurality of sidewalls forming the first duct part 411 may be a sidewall located at the lowest location among the plurality of sidewalls.

The combustion gas flowing into a space between the ceiling surface of the cooking chamber 31 and the upper surface of the reflector 355 may be discharged to the outside of the cooking chamber 31 through the exhaust port 12 formed in the upper surface of the cavity 11.

Further, the combustion gas discharged through the exhaust port 12 may flow upward through the exhaust passages 411*a* and 415*b* formed inside the exhaust duct 41 and may be discharged upward while passing through the vent grill 60 from the rear side of the cooking appliance 1.

In addition, the broil burner 35 may be provided with the ignition device 357. The ignition device 357 serves to ignite the mixed gas discharged from the flame hole. As an example, the ignition device 357 may include a heating element having a ceramic-coated surface. The temperature of the mixed gas discharged from the flame hole of the broil burner 35 may be increased to an ignition temperature due to heat generated by the heating element of the ignition device 357, and accordingly, the broil burner 35 may be ignited.

The ignition device 357 may be disposed between the ceiling surface of the cooking chamber 31 and the reflector 355. In more detail, the ignition device 357 may be disposed below the exhaust port 12. That is, the ignition device 357 may be disposed between the exhaust part 12 and the reflector 355.

[Structure of Blocking Part]

Figure 7:
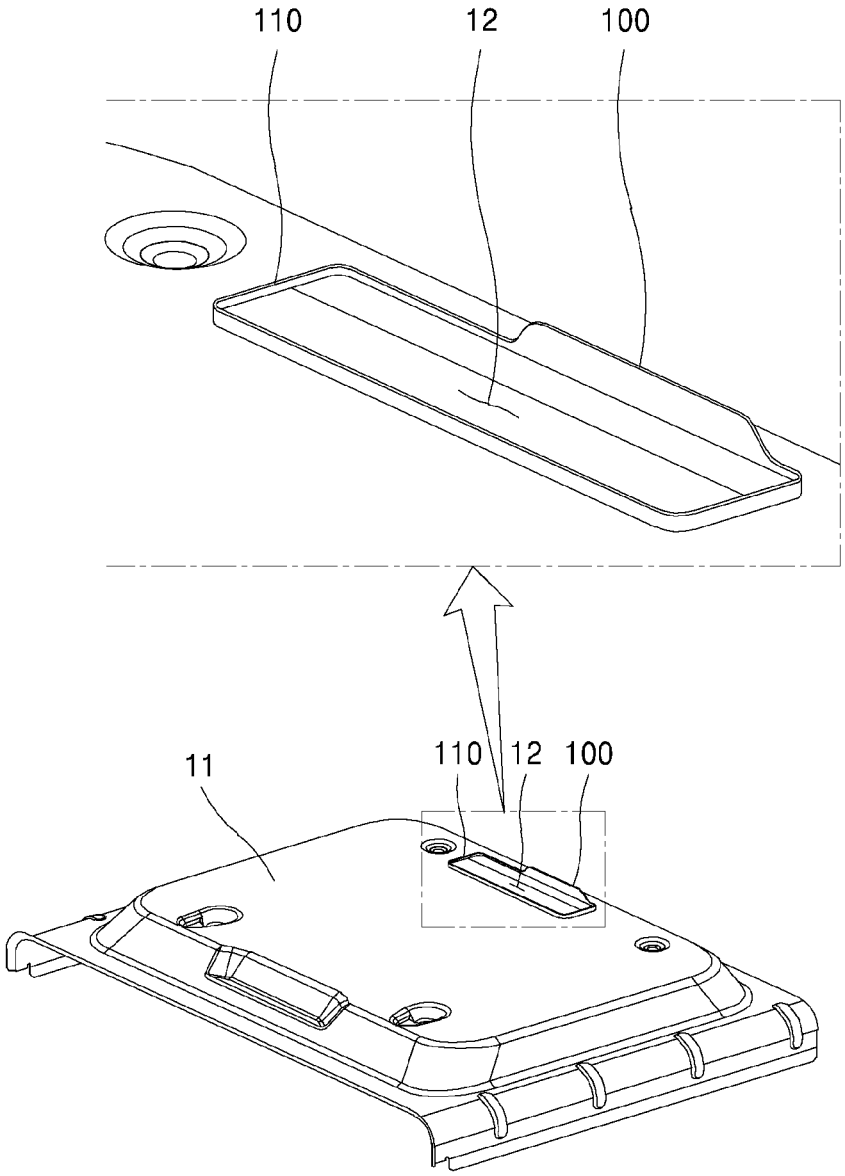
FIG. 7 is a perspective view illustrating a state in which an upper surface of the cavity and a blocking part illustrated in FIG. 5 are separated.
Figure 8:
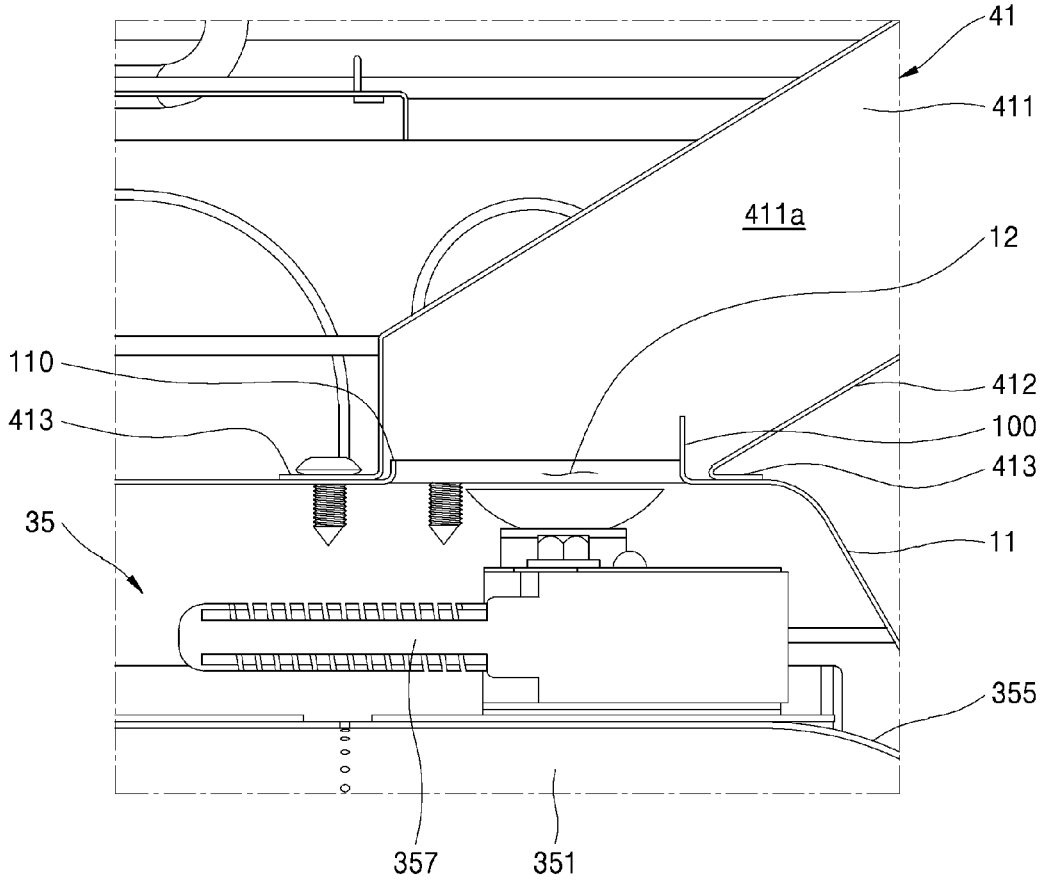
FIG. 8 is a cross-sectional view taken along line "VIII-VIII" of FIG. 5.
Figure 9:
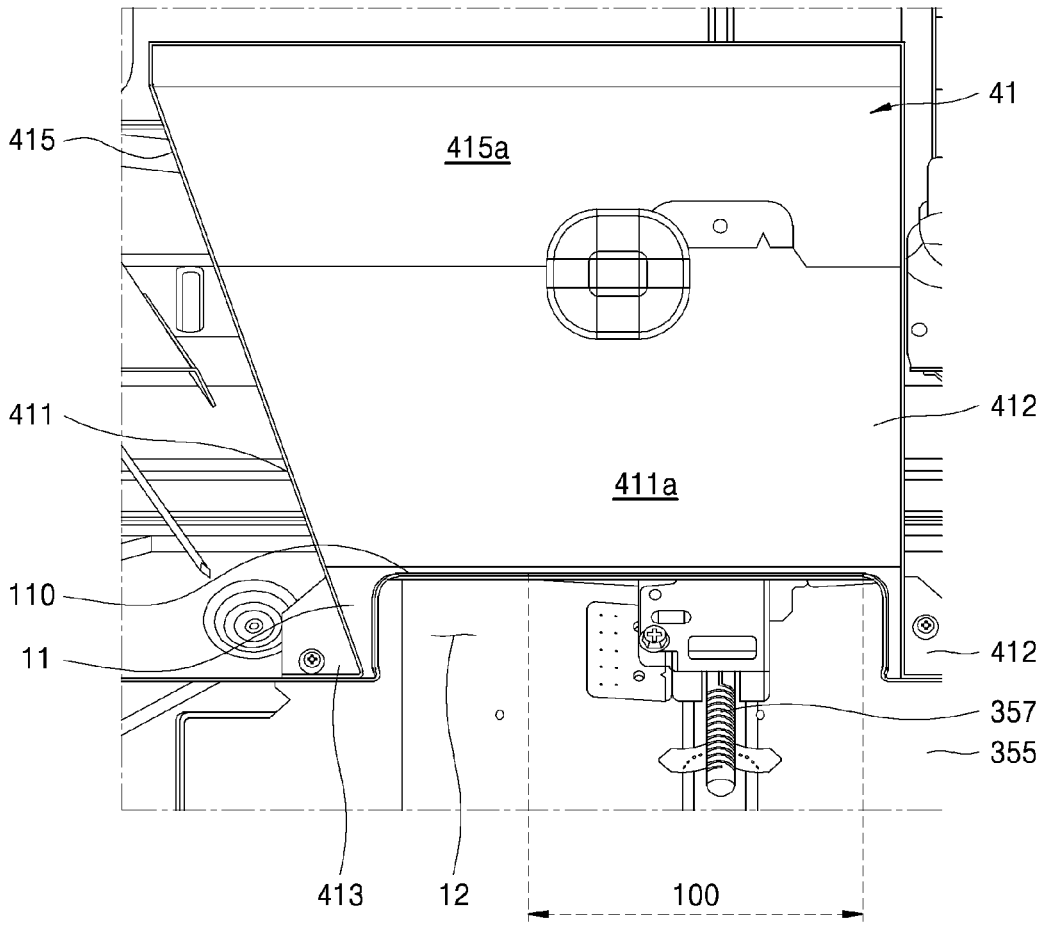
FIG. 9 is a cross-sectional view taken along line "IX-IX" of FIG. 5.

FIG. 7 is a perspective view illustrating a state in which an upper surface of the cavity and a blocking part illustrated in FIG. 5 are separated, FIG. 8 is a cross-sectional view taken along line "VIII-VIII" of FIG. 5, and FIG. 9 is a cross-sectional view taken along line "IX-IX" of FIG. 5.

Referring to FIGS. 6 to 8, a blocking part 100 may be provided inside the exhaust duct 41. The blocking part 100 is provided to block at least a portion of a movement path of water flowing downward from the exhaust passages 411*a* and 415*a* inside the exhaust duct 41 toward the exhaust port 12.

The blocking part 100 may be disposed between the other side of the exhaust passages 411*a* and 415*a* and the exhaust port 12, that is, between an open upper end of the exhaust passages 411*a* and 415*a* and the exhaust port 12. In the present embodiment, it is exemplified that the blocking part 100 is disposed inside the first duct part 411. The blocking part 100 may be disposed between the exhaust port 12 and the rear sidewall 412 that is a sidewall disposed on the rearmost side among the plurality of sidewalls forming the first duct part 411. That is, the blocking part 100 may be disposed between the exhaust port 12 and the rear sidewall 412 inside the first duct part 411.

The blocking part 100 may be provided to protrude vertically from the one side surface of the cavity 11. In the present embodiment, it is exemplified that the blocking part 100 is provided on the upper surface of the cavity 11 and is formed to protrude vertically.

The exhaust port 12 and the rear sidewall 412 may be connected to each other by the one side surface of the cavity 11, that is, the upper surface of the cavity 11. Further, the blocking part 100 may be formed to protrude upward from the upper surface of the cavity 11. That is, the blocking part 100 may be formed integrally with the cavity 11, and the blocking part 100 may be formed by a portion of the upper surface of the cavity 11.

According to the present embodiment, the portion of the upper surface of the cavity 11 may be vertically perforated to form the exhaust port 12. Further, the blocking part 100 may be formed in a form in which a portion of an edge of the cavity 11 surrounding the exhaust port 12 extends upward.

As an example, a protrusion wall part 110 may be provided in the edge of the cavity 11 surrounding the exhaust port 12. The protrusion wall part 110 may be formed to protrude upward from the edge of the cavity 11 surrounding the exhaust port 12.

The protrusion wall part 110 may be formed in the form of a wall surface externally surrounding the exhaust port 12 in a radial direction and may be formed in the form of a wall surface protruding upward from the exhaust port 12 and the edge of the cavity 11 surrounding the exhaust port 12.

For example, the protrusion wall part 110 may be formed in the form of a burr that is generated when the upper surface of the cavity 11 is perforated from the bottom to the top to form the exhaust port 12. A periphery of the exhaust port 12 may be surrounded by the protrusion wall part 110 surrounding a radially outer side of the exhaust port 12.

Unlike the protrusion wall part 110, the blocking part 100 may be formed in a form in which a portion of the edge of the cavity 11 surrounding the exhaust port 12 protrudes or extends upward. Although the protrusion wall part 110 is formed to completely surround the periphery of the exhaust port 12, unlike the protrusion wall part 110, the blocking part 100 does not completely surround the periphery of the exhaust port 12 but may be disposed only in the portion of the edge of the cavity 11 surrounding the exhaust port 12.

Further, in the present embodiment, it is exemplified that the height of the blocking part 100 is greater than the height of the protrusion wall part 110. That is, the blocking part 100 may be formed to protrude upward further than the protrusion wall part 110.

The blocking part 100 may be disposed between the other side of the exhaust passages 411*a* and 415*a* and the ignition device 357. In the present embodiment, it is exemplified that the blocking part 100 is disposed between the second exhaust passage 415*a* and the exhaust port 12. When viewed from the top, the ignition device 357 may be exposed to the upper portion of the exhaust port 12, and the blocking part 100 may be disposed between the exhaust port 12 and the second exhaust passage 415*a* to block at least a portion of a passage between the second exhaust passage 415*a* and the exhaust port 12. The blocking part 100 may block a movement path of water flowing downward from the exhaust passages 411*a* and 415*a* toward the ignition device 357.

The blocking part 100 may be disposed behind the ignition device 357. The blocking part 100 may be disposed behind the exhaust port 12 and thus may be disposed behind at least a portion of the ignition device 357 exposed to the upper portion of the cavity 11, that is, toward the exhaust passages 411*a* and 415*a*, through the exhaust port 12. That is, the blocking part 100 may be disposed behind a portion of the ignition device 357 that is exposed to the upper portion of the cavity 11 through the exhaust port 12.

As illustrated in FIGS. 8 and 9, the width of the blocking part 100 in the left-right direction may be set to be smaller than or equal to the width of the exhaust port 12 in the left-right direction. As an example, the width of the blocking part 100 in the left-right direction may be set to a value between the width of the ignition device 357 in the left-right direction and the width of the exhaust port 12 in the left-right direction. In more detail, the width of the blocking part 100 in the left-right direction may be set to be greater than the width of the ignition device 357 in the left-right direction and to be smaller than the width of the exhaust port 12 in the left-right direction.

The blocking part 100 may be formed to protrude further than the ignition device 357 in the left-right direction. That is, when viewed from the top, both ends of the blocking part 100 in the left-right direction may be formed to protrude to the left side and the right side further than the ignition device 357.

[Action and Effect of Blocking Part]

Figure 10:
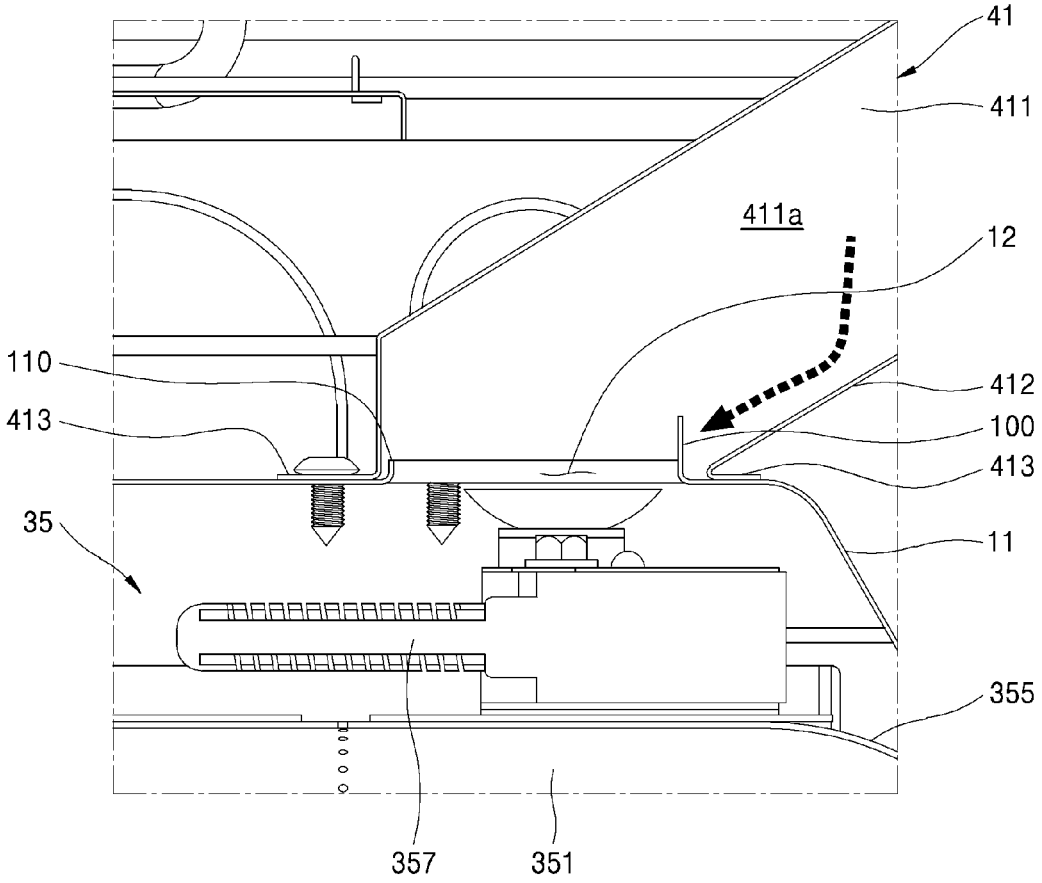
FIG. 10 is a view illustrating a water flow state inside an exhaust duct illustrated in FIG. 8.
Figure 11:
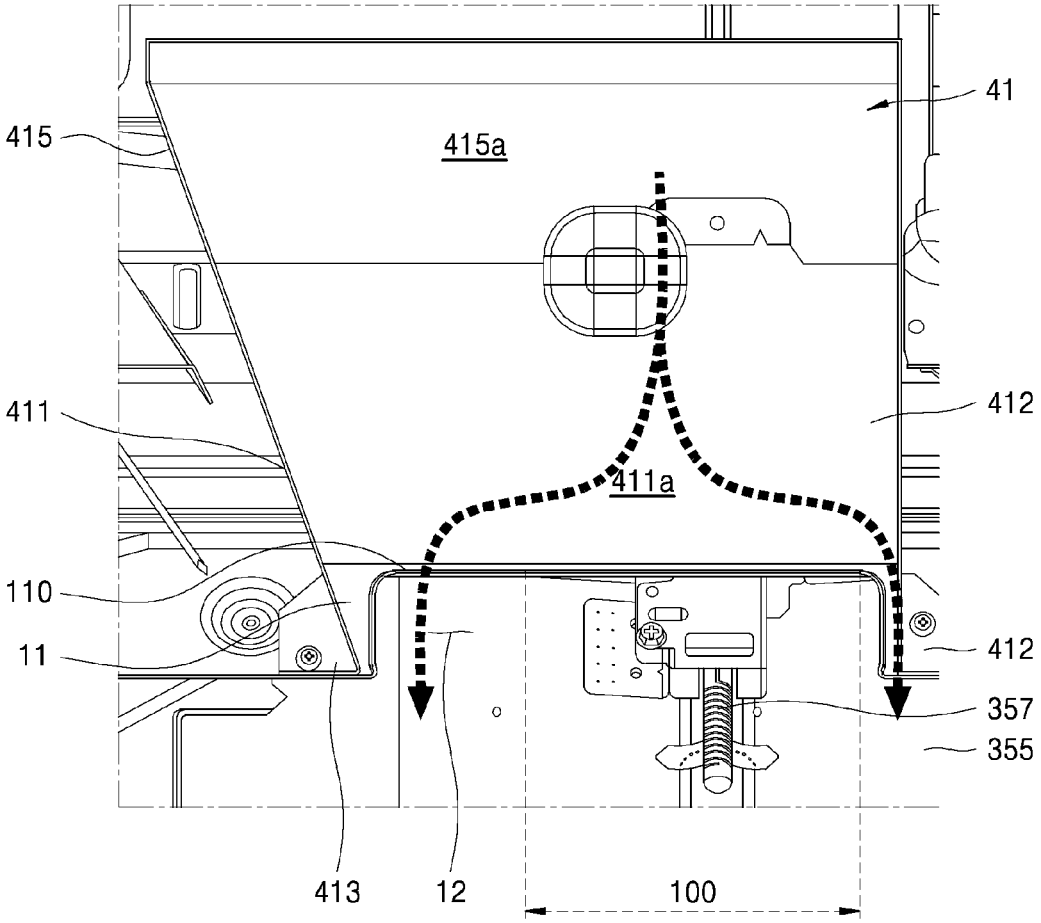
FIG. 11 is a view illustrating a water flow state inside an exhaust duct illustrated in FIG. 9.

FIG. 10 is a view illustrating a water flow state inside an exhaust duct illustrated in FIG. 8, and FIG. 11 is a view illustrating a water flow state inside an exhaust duct illustrated in FIG. 9.

Hereinafter, an action and effect of the cooking appliance including the blocking part according to the present embodiment will be described with reference to FIGS. 10 and 11.

Referring to FIGS. 10 and 11, the blocking part 100 may be disposed behind the exhaust port 12, disposed behind the ignition device 357, formed to protrude further than the ignition device 357 in the left-right direction, and formed to protrude upward further than the protrusion wall part 110 surrounding the exhaust port 12.

When water fills near the vent grill 60 due to water overflowing while the cooktop part 20 or the like is washed using water or cooking is performed in the cooktop part 20, the water may flow into the exhaust duct 41 through the exhaust port 12 of the vent grill 60. Further, in this way, the water flowing into the exhaust duct 41 may flow downward toward the exhaust port 12 through the exhaust passages 411*a* and 415*a*.

In this case, the water introduced into the exhaust duct 41 flows downward toward the exhaust port 12 mainly along the rear sidewall 412 inside the exhaust passages 411*a* and 415*a*. In this way, at least a portion of the flow of the downward flowing water is blocked by the blocking part 100 disposed between the second exhaust passage 415*a* and the exhaust port 12.

As described above, the blocking part 100 is disposed behind the exhaust port 12 and provided to block a gap between the exhaust passages 411*a* and 415*a* and the ignition device 357. The blocking part 100 may block the flow of the water flowing downward toward the ignition device 357 inside the exhaust passages 411*a* and 415*a* main along the rear sidewall 412.

Due to the action of the blocking part 100 as described above, the water flowing downward along the exhaust duct 41 is blocked by the blocking part 100, does not flow downward toward a lower portion of the exhaust port 12, and is spread to the periphery of the exhaust port 12.

The periphery of the exhaust port 12 is surrounded by the protrusion wall part 110. That is, the periphery of the exhaust port 12 is surrounded by the blocking part 100 and the protrusion wall part 110, and a passage connecting the exhaust passages 411*a* and 415*a* and the exhaust port 12 is in a state of being blocked by the blocking part 100 and the protrusion wall part 110.

The water, which is blocked by the blocking part 100, does not flow downward to the lower portion of the exhaust port 12, and is spread to the periphery of the exhaust port 12, may not flow downward to the lower portion of the exhaust port 12 due to the protrusion wall part 110, may be gradually spread from the upper surface of the cavity 11, and then may be vaporized by heat of the cavity 11.

That is, the water blocked by the blocking part 100 and spread to the periphery of the exhaust port 12 may not flow downward toward the ignition device 357 through the exhaust port 12 eventually and may be removed by being vaporized by the heat of the cavity 11 heated by operating the heating part such as the broil burner 35 while being spread from the upper surface of the cavity 11.

The blocking part 100 is formed to protrude upward further than the protrusion wall part 110. Unlike the protrusion wall part 110 surrounding the periphery of the exhaust port 12, the blocking part 100 is formed to have a width sufficient to block movement of the water to the ignition device 357 without surrounding the entire periphery of the exhaust port 12. That is, the blocking part 100 is formed so as not to surround the entire periphery of the exhaust port 12.

The blocking part 100 is a structure protruding from the inside of the exhaust passages 411*a* and 415*a*, and in this way, the structure protruding from the inside of the exhaust passages 411*a* and 415*a* may act as obstacles that hinder exhaust flow inside the exhaust passages 411*a* and 415*a*.

As the width of the blocking part 100 becomes greater, and as the height of the blocking part 100 becomes greater, penetration of the water into the ignition device 357 may be blocked more effectively. However, as the width of the blocking part 100 becomes greater, and as the height of the blocking part 100 becomes greater, obstruction the exhaust flow made by the blocking part 100 inside the exhaust passages 411*a* and 415*a* inevitably becomes severe.

Thus, it is preferable that the width and the height of the blocking part 100 are set to a length at which the penetration of the water into the ignition device 357 may be effectively blocked even without hindering the exhaust flow inside the exhaust passages 411*a* and 415*a*.

In consideration of this point, the width of the blocking part 100 may be formed to be slightly greater than the width of the ignition device 357. As an example, the blocking part 100 may be formed in a width at which both sides of the blocking part 100 in the left-right direction may protrude from both sides of the ignition device 357 in the left-right direction by the range of about 10 mm to 20 mm. For example, when the width of the ignition device 357 is about 45 mm, the width of the blocking part 100 may be set in the range of about 65 mm to 85 mm.

Further, the height of the blocking part 100 may be set to be greater than the height of the protrusion wall part 110 and may be set to a height at which a sufficient space required for the flow of the combustion gas is secured between an upper end of the blocking part 100 and a ceiling surface of the exhaust duct 41. As an example, the height of the blocking part 100 may be set in consideration of whether the penetration of the water into the ignition device 357 may be blocked and the concentration of carbon monoxide (CO) in the combustion gas discharged through the exhaust duct 41. For example, the height of the blocking part 100 may be set to a height at which, when the set amount of the water flows into the exhaust duct 41, the penetration of the water into the ignition device 357 may be blocked effectively, and the concentration of carbon monoxide (CO) in the combustion gas discharged through the exhaust duct 41 may be maintained at a set value or less.

In addition, in the present embodiment, it is exemplified that the blocking part 100 is formed to protrude vertically upward.

When the blocking part 100 is formed to be inclined forward toward the exhaust port 12, a possibility that the water flowing downward from the inside of the exhaust duct 41 may not be blocked by the blocking part 100 and may overflow toward the exhaust port 12 over the blocking part 100 increases.

Further, when the blocking part 100 is formed to be inclined forward toward the exhaust port 12, the blocking part 100 may become an obstacle that narrows a gap between the upper end of the blocking part 100 and the ceiling surface of the exhaust duct 41 to obstruct the exhaust flow.

Further, when the blocking part 100 is formed to be inclined forward toward the exhaust port 12, in order to prevent the water from overflowing, the length of the blocking part 100 should be further increased. In this case, the blocking part 100 inevitably becomes an obstacle that more seriously obstructs the exhaust flow.

In contrast, when the blocking part 100 is formed to be inclined rearward toward the rear sidewall 412, a possibility that the blocking part 100 hinders the exhaust flow can be significantly reduced. However, in this case, since the gap between the blocking part 100 and the exhaust duct 41 is narrowed, a possibility that the water cannot be properly blocked by the blocking part 100 increases.

In consideration of this point, in the present embodiment, it is exemplified that the blocking part 100 is formed to protrude vertically upward. In this way, since the blocking part 100 is formed to be protrude vertically upward, the penetration of the water into the ignition device 357 may be effectively blocked, and despite the existence of the protrusion structure such as the blocking part 100, the exhaust flow inside the exhaust duct 41 may be smoothly maintained.

Meanwhile, the protrusion wall part 110 surrounding the exhaust port 12 at a location adjacent to the blocking part 100, along with the blocking part 100, may serve to block the penetration of the water into the ignition device 357.

The water, which is blocked by the blocking part 100, does not flow downward to the lower portion of the exhaust port 12, and is spread to the periphery of the exhaust port 12, is gradually spread out from the upper surface of the cavity 11. In this way, the water spread out from the upper surface of the cavity 11 may not flow downward to the lower portion of the exhaust port 12 due to the protrusion wall part 110 surrounding the exhaust port 12 and protruding upward and may be vaporized by the heat of the cavity 11 while staying on the upper surface of the cavity 11. That is, the protrusion wall part 110 may serve to assist a function of the blocking part 100 in the vicinity of the blocking part 100.

As described above, the protrusion wall part 110 may be formed in a form in which the portion of the edge of the cavity 11 surrounding the exhaust port 12 protrudes or extends upward. Accordingly, a wall surface by the protrusion wall part 110 instead of a sharp cut surface may be formed in an inner edge of the cavity 11 surrounding the exhaust port 12. As a result, the risk that a worker is injured due to the sharp cut surface around the exhaust port 12 can be significantly reduced.

Further, as the protrusion structure such as the protrusion wall part 110 is formed on the upper surface of the cavity 11, the upper surface of the cavity 11 may be flattened more easily, and accordingly, the flattening of the upper surface of the cavity 11 may be performed more effectively.

Further, the protrusion wall part 110 forming the protrusion structure on the upper surface of the cavity 11 may serve to guide an installation location of the exhaust duct 41. For example, in a process of installing the exhaust duct 41, an installation location of the exhaust duct 41 with respect to the cavity 11 may be guided to a location in which interference occurs between an inner surface of the first duct part 411 and the protrusion wall part 110. Accordingly, the exhaust duct 41 may be installed more easily, more rapidly, and more accurately.

In the cooking appliance 1 according to the present embodiment as described above, a flow path of the water to the ignition device 357 through the exhaust port 12 from the exhaust passages 411*a* and 415*a* is blocked using the blocking part 100 protruding upward from the upper surface of the cavity 11 and disposed inside the exhaust duct 41 and behind the exhaust port 12, and thus the water introduced through the exhaust duct 41 from the outside of the cooking appliance 1 may be effectively blocked from penetrating into the heat source.

Further, in the cooking appliance 1 of the present embodiment, since the flow path of the water to the ignition device 357 through the exhaust port 12 from the exhaust passages 411*a* and 415*a* is blocked by the blocking part 100, the water introduced through the exhaust duct 41 from the outside of the cooking appliance 1 may be effectively blocked from being introduced into the ignition device 357, and accordingly, occurrence of an ignition failure of the broil burner 35 may be effectively suppressed.

[Another Example of Blocking Part]

Meanwhile, the cooking appliance having the blocking part as configured above is merely an exemplary embodiment of the present disclosure, and various embodiments that may replace the embodiment may be present.

Figure 12:
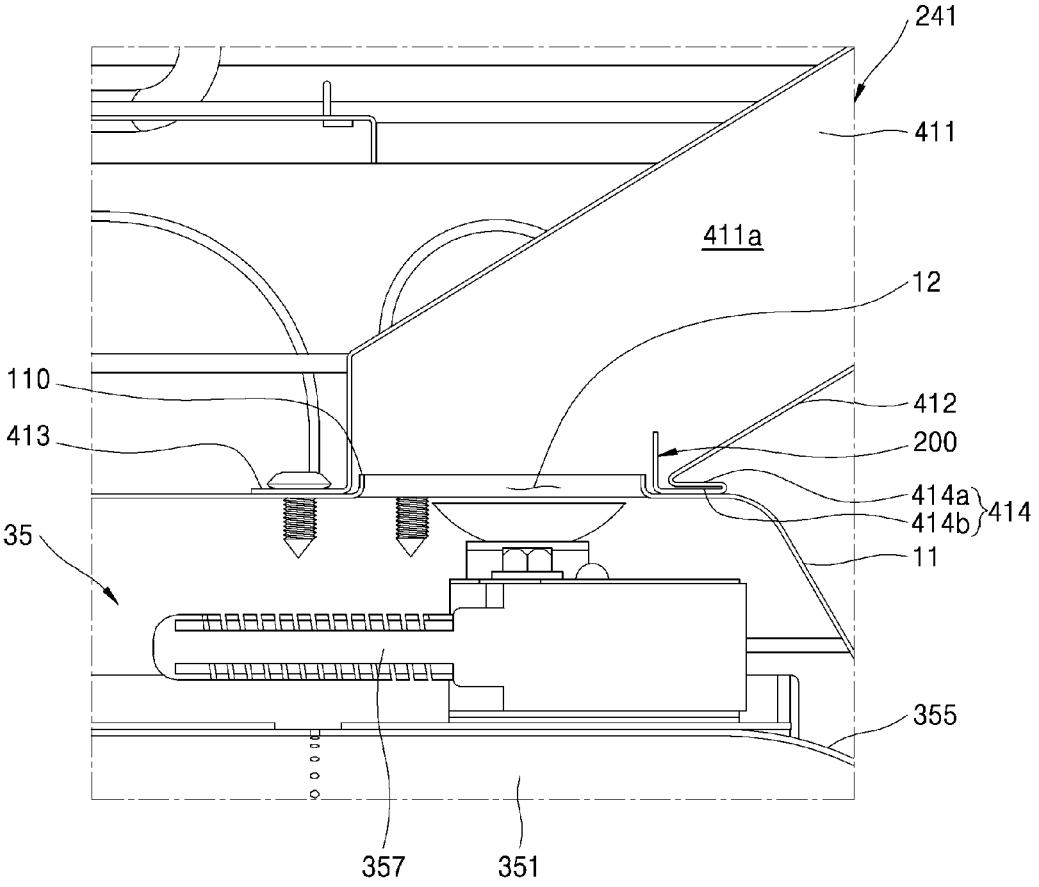
FIG. 12 is a view illustrating a configuration of a blocking part according to another embodiment of the present disclosure.

FIG. 12 is a view illustrating a configuration of a blocking part according to another embodiment of the present disclosure.

Hereinafter, a structure of a blocking part according to another embodiment of the present disclosure will be described with reference to FIG. 12.

Here, the same reference numerals as in the drawings as illustrated above are designated by the same members having the same functions, and thus, a duplicated description thereof will be omitted.

Referring to FIG. 12, a blocking part 200 according to another embodiment of the present disclosure may be formed in an exhaust duct 241 instead of the cavity 11.

Accordingly, at least one of coupling parts 414 of the exhaust duct 241 may include a first protrusion part 414*a* and a second protrusion part 414*b*. In the present embodiment, it is exemplified that the coupling part 414 located at a lower end of a rear sidewall 412 includes the first protrusion part 414*a* and the second protrusion part 414*b*.

The first protrusion part 414*a* may extend rearward from the rear sidewall 412 to protrude rearward from the rear sidewall 412. The first protrusion part 414*a* may form a flat surface parallel to the upper surface of the cavity 11 and may protrude rearward from the rear sidewall 412.

The second protrusion part 414*b* is formed to extend from a lower end of the first protrusion part 414*a*. The second protrusion part 414*b* may be formed to extend from the lower end of the first protrusion part 414*a* to the front side of the rear sidewall 412. For example, the second protrusion part 414*b* may be formed in a flat surface parallel to the first protrusion part 414*a* and a connection portion between the rear sidewall 412 and the first protrusion part 414*a* may be provided at a rear end of the rear sidewall 412. Further, a connection portion between the first protrusion part 414*a* and the second protrusion part 414*b* may be provided at a front end of the rear sidewall 412, and the second protrusion part 414*b* may be disposed below the first protrusion part 414*a* and disposed between the upper surface of the cavity 11 and the first protrusion part 414*a*. The second protrusion part 414*b* may be coupled to the cavity 11 while being in contact with the upper surface of the cavity 11.

The blocking part 200 may extend upward from a front end of the second protrusion part 414*b*. The blocking part 200 may be formed to protrude upward from one side surface of the cavity 11, that is, the upper surface of the cavity 11.

Like the blocking part 100 (see FIG. 8) illustrated in the above-described embodiment, the blocking part 200 may be disposed inside the exhaust duct 241 and disposed between the rear sidewall 412 and the exhaust port 12.

The blocking part 200 may be formed integrally with the exhaust duct 241. That is, the blocking part 200 of the present embodiment may be formed integrally with the exhaust duct 241 by bending a lower end of the exhaust duct 241.

Like the blocking part 100 as described in the above embodiment, in the blocking part 200, the water introduced through the exhaust duct 241 from the outside of the cooking appliance 1 can be effectively blocked from penetrating into the heat source. Therefore, occurrence of an ignition failure of the broil burner 35 can be effectively suppressed, and of course, the blocking part 200 may be easily processed on the exhaust duct 241 only using a simple operation of simply changing the shape of the exhaust duct 241.

That is, the blocking part 200 of the present embodiment can be easily manufactured only using a simple operation of adding a bending process to the exhaust duct 241 and can be easily applied to the cooking appliance 1 only using a simple operation of installing the exhaust duct 241, in which the blocking part is processed, in the cooking appliance 1.

In a cooking appliance of the present disclosure, a water flow path through which water flows from an exhaust passage through an exhaust port to an ignition device 357 is blocked using a blocking part that protrudes upward from an upper surface of a cavity and is disposed inside an exhaust duct and behind the exhaust port, and thus the penetration of the water introduced through the exhaust duct from the outside of the cooking appliance can be effectively blocked.

Further, according to the present disclosure, since the water flow path through which water flows from the exhaust passage through the exhaust port to the ignition device is blocked using the blocking part, the water introduced through the exhaust duct from the outside of the cooking appliance can be effectively blocked from being introduced into the ignition device, and thus the occurrence of an ignition failure of a heat source such as a boil burner can be effectively suppressed.

Although the present disclosure has been described with reference to the embodiments illustrated in the drawings, the description is merely illustrative, and those skilled in the art to which the technology belongs could understand that various modifications and other equivalent embodiments may be made. Thus, the true technical scope of the present disclosure should be determined by the appended claims.

DESCRIPTION OF REFERENCE NUMERALS

1: Cooking appliance
10: Body
11: Cavity
13: Front panel
14: Intake port
15: Rear cover
16: Vent hole
17: Side panel
20: Cooktop part
21: Top plate
22: Cooktop heating part
30: Oven part
30*a*: Partition surface
31: Cooking chamber
32: Door
33: Handle
34: Rear space
35: Broil burner
351: Burner body
353: Mixing tube
355: Reflector
357: Ignition device
37: Convention part
40: Upper space
41, 241: Exhaust duct
411: First duct part
411*a*: First exhaust passage
412: Rear sidewall
413, 414: Coupling part
415: Second duct part
415*a*: Second exhaust passage
50: Control panel
51: Input unit
52: Display
60: Vent grill
100, 200: Blocking part
110: Protrusion wall part

What is claimed is:

1. A cooking appliance comprising:

an oven part including a cavity in which a cooking chamber is formed;

a cooktop part including a top plate covering an upper portion of the cavity so that an upper space is formed between the cavity and the top plate and at least one cooktop heating part of which at least a portion thereof is disposed in the upper space;

an exhaust duct that forms a passage connecting an inside of the cooking chamber and the top plate; and a blocking part that blocks at least a portion of a movement path of water flowing downward from an inside of the exhaust duct, wherein:

a portion of one side surface of the cavity that faces the cooktop part is vertically perforated to form an exhaust port and a protrusion wall part protruding upward from an edge of the cavity surrounding the exhaust port, and wherein the blocking part and the protrusion wall part are formed by a portion of the edge of the cavity surrounding the exhaust port being extended upward.

2. The cooking appliance of claim 1, wherein:

the oven part includes the exhaust port vertically passing through one side surface of the cavity that faces the cooktop part;

an exhaust passage formed inside the exhaust duct and having one side connected to the exhaust port and another side that is open to the top plate; and the blocking part blocks the at least a portion of the movement path of water flowing downward toward the exhaust port through the exhaust passage.

3. The cooking appliance of claim 2, wherein the blocking part is disposed between the other side of the exhaust passage and the exhaust port and vertically protrudes from the one side surface of the cavity.

4. The cooking appliance of claim 1, wherein the blocking part is disposed on one side surface of the cavity and protrudes vertically.

5. The cooking appliance of claim 1, wherein the blocking part is formed integrally with the cavity.

6. The cooking appliance of claim 5, wherein:

a portion of the one side surface of the cavity that faces the cooktop part is vertically perforated to form an exhaust port; and the blocking part is formed by a portion of an edge of the cavity surrounding the exhaust port being extended upward.

7. The cooking appliance of claim 1, wherein:

the oven part includes the exhaust port vertically passing through one side surface of the cavity that faces the cooktop part;

the exhaust passage formed inside the exhaust duct and having one side connected to the exhaust port and an other side that is open to the top plate;

the cooking appliance further includes a burner disposed inside the cooking chamber, the burner includes an ignition device disposed below the exhaust port; and the blocking part is disposed between the other side of the exhaust passage and the ignition device to block the at least a portion of the movement path of water flowing downward toward the ignition device through the exhaust passage.

8. The cooking appliance of claim 7, wherein:

the blocking part is disposed behind the ignition device, and a width of the blocking part in a left-right direction is greater than a width of the ignition device in the left-right direction such that the blocking part protrudes further than the ignition device in the left-right direction.

9. The cooking appliance of claim 1, wherein:

the oven part includes the exhaust port vertically passing through one side surface of the cavity that faces the cooktop part, and the exhaust duct includes a first duct part having a first exhaust passage formed therein and connected to the exhaust port, and a second duct part having a second exhaust passage formed therein and having one side connected to the first exhaust passage and an other side that is open to the top plate, the second duct part is disposed behind the exhaust port, the first duct part extends to be inclined upward from the exhaust port toward the second duct part; and the blocking part is disposed inside the first duct part.

10. The cooking appliance of claim 9, wherein:

the first duct part includes a plurality of sidewalls connecting the one side surface of the cavity and the second duct part, the plurality of sidewalls are connected to each other while surrounding the first exhaust passage in a front-rear direction and in a left-right direction; and the blocking part is disposed between the exhaust port and a rear sidewall that is a rearmost sidewall among the plurality of sidewalls.

11. The cooking appliance of claim 10, wherein:

the rear sidewall and the exhaust port are connected to each other at the one side surface of the cavity; and the blocking part protrudes upward from the one side surface of the cavity.

12. The cooking appliance of claim 10, wherein:

the first duct part includes coupling parts protruding from the plurality of sidewalls and coupled to the one side surface of the cavity, and a coupling part among the coupling parts protrude from a lower end of the rear wall in a direction parallel to the one side surface of the cavity.

13. The cooking appliance of claim 12, wherein:

the coupling part includes a first protrusion part extending rearward from the rear sidewall and protruding rearward from the rear sidewall and a second protrusion part extending from a lower end of the first protrusion part and protruding forward from the rear sidewall; and the blocking part extends upward from a front end of the second protrusion part to protrude upward from an upper portion of the one side surface of the cavity.

14. The cooking appliance of claim 1, wherein the height of the blocking part is greater than the height of the protrusion wall part.

15. The cooking appliance of claim 1, wherein the blocking part is disposed further rearward than the protrusion wall part.

16. The cooking appliance of claim 2, wherein the blocking part is disposed on the one side surface of the cavity and protrudes vertically.

* * * * *